US010494837B2

(12) United States Patent
Mitchell et al.

(10) Patent No.: US 10,494,837 B2
(45) Date of Patent: Dec. 3, 2019

(54) UNIVERSAL RAIL FOR UTILITY PIT

(71) Applicant: Mueller International, LLC, Atlanta, GA (US)

(72) Inventors: Timothy J. Mitchell, Chattanooga, TN (US); Trace Pierce, McDonald, TN (US); Aaron Cleek, Palmer, TN (US)

(73) Assignee: Mueller International, LLC, Atlanta, GA (US)

( * ) Notice: Subject to any disclaimer, the term of this patent is extended or adjusted under 35 U.S.C. 154(b) by 0 days.

(21) Appl. No.: 16/162,518

(22) Filed: Oct. 17, 2018

(65) Prior Publication Data

US 2019/0048620 A1 Feb. 14, 2019

Related U.S. Application Data

(62) Division of application No. 15/432,182, filed on Feb. 14, 2017, now Pat. No. 10,385,590.

(51) Int. Cl.

| | |
|---|---|
| ***E05B 65/00*** | (2006.01) |
| ***E05C 1/12*** | (2006.01) |
| ***E02D 29/14*** | (2006.01) |
| *E05C 19/00* | (2006.01) |
| *E05B 15/02* | (2006.01) |

(52) U.S. Cl.

CPC ..... *E05B 65/0089* (2013.01); *E02D 29/14* (2013.01); *E05B 65/006* (2013.01); *E05C 1/12* (2013.01); *E05B 15/021* (2013.01); *E05C 19/005* (2013.01)

(58) Field of Classification Search

CPC .. E05B 65/0089; E05B 65/006; E05B 15/021; E05C 1/12; E05C 19/005; E02D 29/14

See application file for complete search history.

(56) References Cited

U.S. PATENT DOCUMENTS 1,364,422 A * 1/1921 Armstrong ..... E02D 29/14 49/278
1,926,595 A * 9/1933 Mulvihill ..... B66F 19/005 49/276

(Continued)

OTHER PUBLICATIONS

Mitchell, Timothy J.; Requirement for Restriction/Election for U.S. Appl. No. 15/432,182, filed Feb. 14, 2017, dated Jul. 23, 2018, 7 pgs.

(Continued)

*Primary Examiner* — Jessie T Fonseca

(74) *Attorney, Agent, or Firm* — Taylor English Duma LLP

(57) ABSTRACT

A pit assembly comprises: a pit wall defining an inner surface, and an outer surface; a rail secured to the inner surface of the pit wall, the rail comprising: a top end, a bottom end, a first side end, a second side end, and an outer face defining a curved radially outer surface and mounted on the inner surface of the pit wall; a center-lock strike portion proximate to the first side end; and a side-lock strike portion distal from the first side end, a one of the center-lock strike portion and the side-lock strike portion defining a strike notch in the bottom end; and a lid defining an upper surface and a lower surface and comprising a locking mechanism, the locking mechanism coupled to the lower surface and configured to engage a one of the center-lock strike portion and the side-lock strike portion of the rail.

21 Claims, 13 Drawing Sheets

(56) References Cited

U.S. PATENT DOCUMENTS 2,363,567 A * 11/1944 Blakeman ..... E02D 29/1427 292/6
3,046,853 A * 7/1962 *Legendre ..... E02D 29/14 220/284
4,969,770 A * 11/1990 Bowman ..... E02D 29/124 404/26
5,051,022 A * 9/1991 Bowman ..... E02D 29/124 404/26
5,165,819 A * 11/1992 Bowman ..... E02D 29/124 404/26
5,240,346 A * 8/1993 Yin ..... E02D 29/149 404/25
5,312,202 A * 5/1994 Newton ..... E02D 29/14 404/25
5,326,188 A * 7/1994 Bowman ..... E02D 29/14 292/256.71
5,525,006 A * 6/1996 Kilman ..... E02D 29/12 404/25
5,697,729 A * 12/1997 Bowman ..... E02D 29/1427 404/25
6,749,363 B1 * 6/2004 Petersen ..... E02D 29/14 404/25
6,886,577 B1 * 5/2005 Phillips ..... E02D 29/14 137/15.01
7,160,051 B1 * 1/2007 Cuny ..... E02D 29/14 404/25
7,251,914 B1 * 8/2007 Petersen ..... E02D 29/14 244/114 R
7,695,213 B1 * 4/2010 Akkala ..... E02D 29/1427 404/25
8,714,867 B1 * 5/2014 Vrondran ..... E02D 29/14 404/25
10,385,590 B2 8/2019 Mitchell et al.
2007/0059094 A1 * 3/2007 He ..... E02D 29/14 404/25
2009/0321442 A1 * 12/2009 Stetson ..... E02D 29/14 220/200
2010/0012671 A1 * 1/2010 Vrondran ..... E02D 29/14 220/810
2011/0072629 A1 * 3/2011 Flood, Jr. ..... E02D 29/14 29/428
2011/0222963 A1 * 9/2011 Kelley ..... E02D 29/14 404/25
2012/0251239 A1 * 10/2012 Banks ..... E02D 29/14 404/25
2012/0267373 A1 * 10/2012 Starr ..... B65D 45/345 220/319
2013/0089373 A1 * 4/2013 Bax ..... E02D 29/14 404/25
2014/0169876 A1 * 6/2014 Reynolds ..... E02D 29/1436 404/26
2016/0236764 A1 * 8/2016 Combs ..... B64C 1/14
2016/0289912 A1 * 10/2016 Smith ..... E02D 29/128
2017/0260712 A1 * 9/2017 Dang ..... E02D 29/14
2018/0230712 A1 8/2018 Mitchell et al.

OTHER PUBLICATIONS

Ford; Catalog for Ford Plastic Pit Setters, published Feb. 2015, revised Mar. 18, 2016, 28 pgs.
McDonald; Submittal Data Sheet for NL Coil Pitt Setter; publicly available prior to Feb. 14, 2017, 1 pg.
Mueller Co.; Catalog for Mueller Thermal-Coil Meter Box, publicly available prior to Feb. 14, 2016, 16 pgs.
Mitchell, Timothy J.; Non-Final Office Action for U.S. Appl. No. 15/432,182, filed Feb. 14, 2017, dated Jan. 2, 2019, 14 pgs.
Mitchell, Timothy J.; Notice of Allowance for U.S. Appl. No. 15/432,182, filed Feb. 14, 2017, dated Apr. 22, 2019, 5 pgs.
Mitchell, Timothy J.; Supplemental Notice of Allowance for U.S. Appl. No. 15/432,182, filed Feb. 14, 2017, dated May 28, 2019, 6 pgs.
Mitchell, Timothy J.; Corrected Notice of Allowance for U.S. Appl. No. 15/432,182, filed Feb. 14, 2017, dated Jul. 22, 2019, 6 pgs.

* cited by examiner

UNIVERSAL RAIL FOR UTILITY PIT

TECHNICAL FIELD REFERENCE TO RELATED APPLICATIONS

This application is a divisional of U.S. patent application Ser. No. 15/432,182, filed on Feb. 14, 2017, which is hereby specifically incorporated by reference herein in its entirety.

TECHNICAL FIELD

Field of Use

This disclosure relates to utility pits. More specifically, this disclosure relates to utility pits comprising a rail configured to engage a lockable lid.

Related Art

Utility pits can provide a convenient structure for housing utility meters or other utility-related equipment, can provide storage space, or can make possible the passage of equipment, tools, or personnel from an area above the utility pit to an interior cavity of the utility pit or an area accessible through and below the utility pit. To ensure the safety of people in the vicinity of the utility pit and protection of equipment within the utility pit, each is typically equipped with a lid.

Cost-effectively manufacturing utility pits to provide the end user's preferred lid configuration can be challenging. It is typical for utility pits that are lockable to accommodate only a single type of lid comprising a particular type of lock. Further, in the case of utility pits comprising a utility meter that is installed at a sufficient depth below an upper end of the utility pit to avoid the risk of freezing temperatures (or for any other reason), it can be necessary to raise the utility meter for service or replacement. A raised utility meter, which may be installed on a movable platform, can be at risk for falling from its temporary perch and causing damage to person or property.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a rail for a utility pit comprising: a top end; a bottom end distal from the top end; an outer face defining a curved radially outer surface, the radially outer surface configured to mount on an inner surface of the utility pit; an inner face distal from the outer face and defining a radially inner surface; a center-lock strike portion proximate to a first side end of the rail, the center-lock strike portion defining a center-lock strike notch in the bottom surface; and a side-lock strike portion distal from the first side end, the side-lock strike portion defining a side-lock strike notch, the side-lock strike notch defining a central wall and a pair of side walls extending radially inward from the central wall, a surface of each of the pair of side walls angled with respect to the central wall.

In a further aspect, disclosed is a pit assembly comprising: a pit wall defining an inner surface, an outer surface, an upper end defining a pit opening, and a lower end, the inner surface defining an interior cavity; a rail secured to the inner surface of the pit wall, the rail comprising: a top end defining a top surface, a bottom end distal from the top end and defining a bottom surface, a first side end, a second side end distal from the first side end, an outer face defining a curved radially outer surface extending from the top end to the bottom end and mounted on an inner surface of the pit wall, and an inner face distal from the outer face and defining a radially inner surface; a center-lock strike portion proximate to the first side end; and a side-lock strike portion distal from the first side end, a one of the center-lock strike portion and the side-lock strike portion defining a strike notch in the bottom end, a central wall of the strike notch offset from a one of a radially innermost portion of the radially inner surface and the bottom surface of the rail; and a lid defining an upper surface and a lower surface and comprising a locking mechanism, the locking mechanism coupled to the lower surface and configured to engage a one of the center-lock strike portion and the side-lock strike portion of the rail.

In yet another aspect, disclosed is a method for accessing a pit assembly, the method comprising: removing a lid of the pit assembly from an upper end of a pit wall of the pit assembly; raising a platform of the pit assembly; and supporting the platform with a rail of the pit assembly, the rail mounted on an inner surface of the pit wall and comprising: a top end defining a top surface, a bottom end distal from the top end, and a first side end; a center-lock strike portion proximate to the first side end; and a side-lock strike portion distal from the first side end, the side-lock strike portion defining a strike notch in the bottom end, the strike notch defining a central wall and a side wall angled with respect to the central wall.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
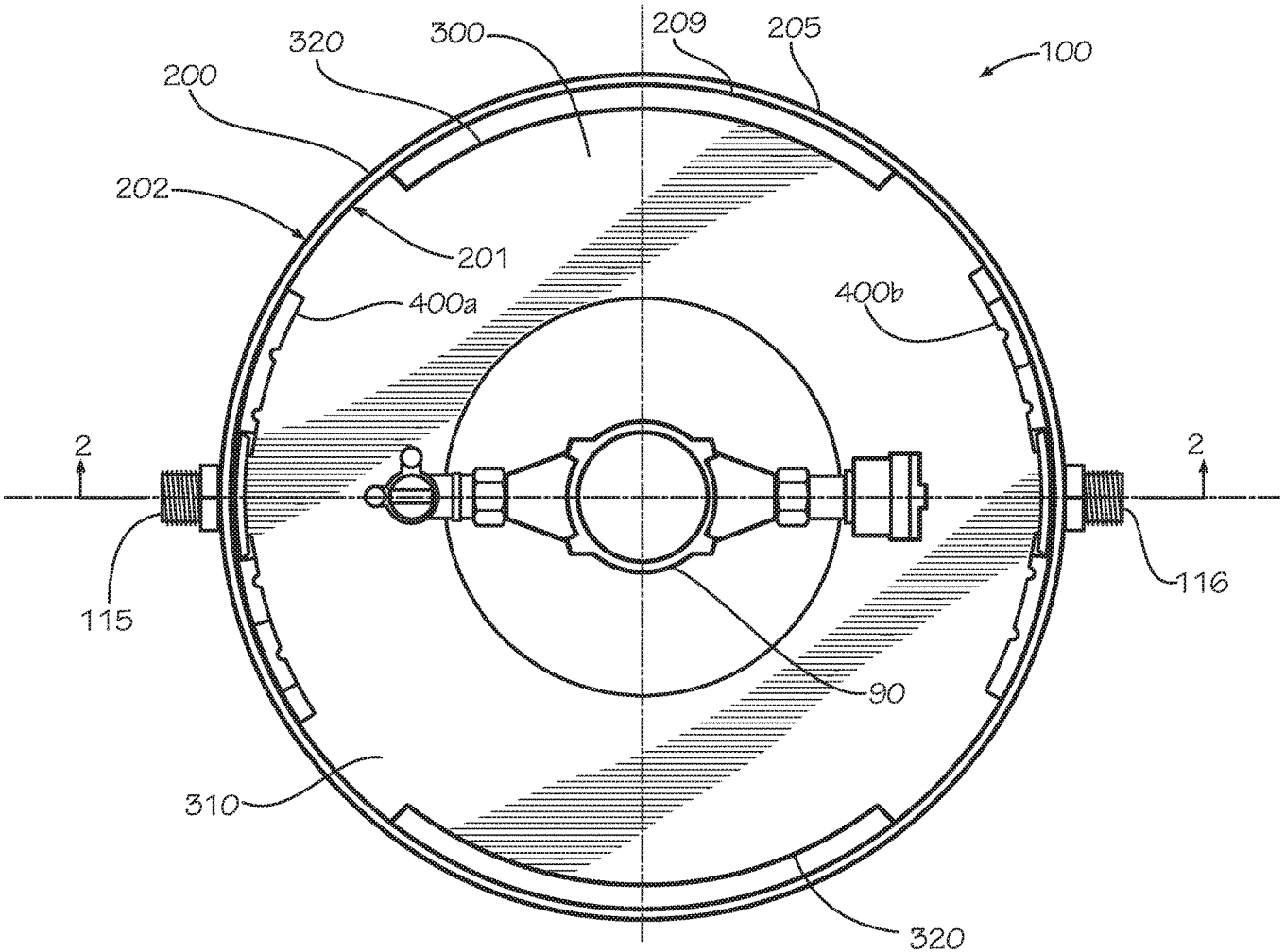
FIG. 1 is a top view of a pit assembly in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

In one aspect, a pit assembly and associated methods, systems, devices, and various apparatuses are disclosed herein. In one aspect, the pit assembly can comprise a rail.

Figure 2:
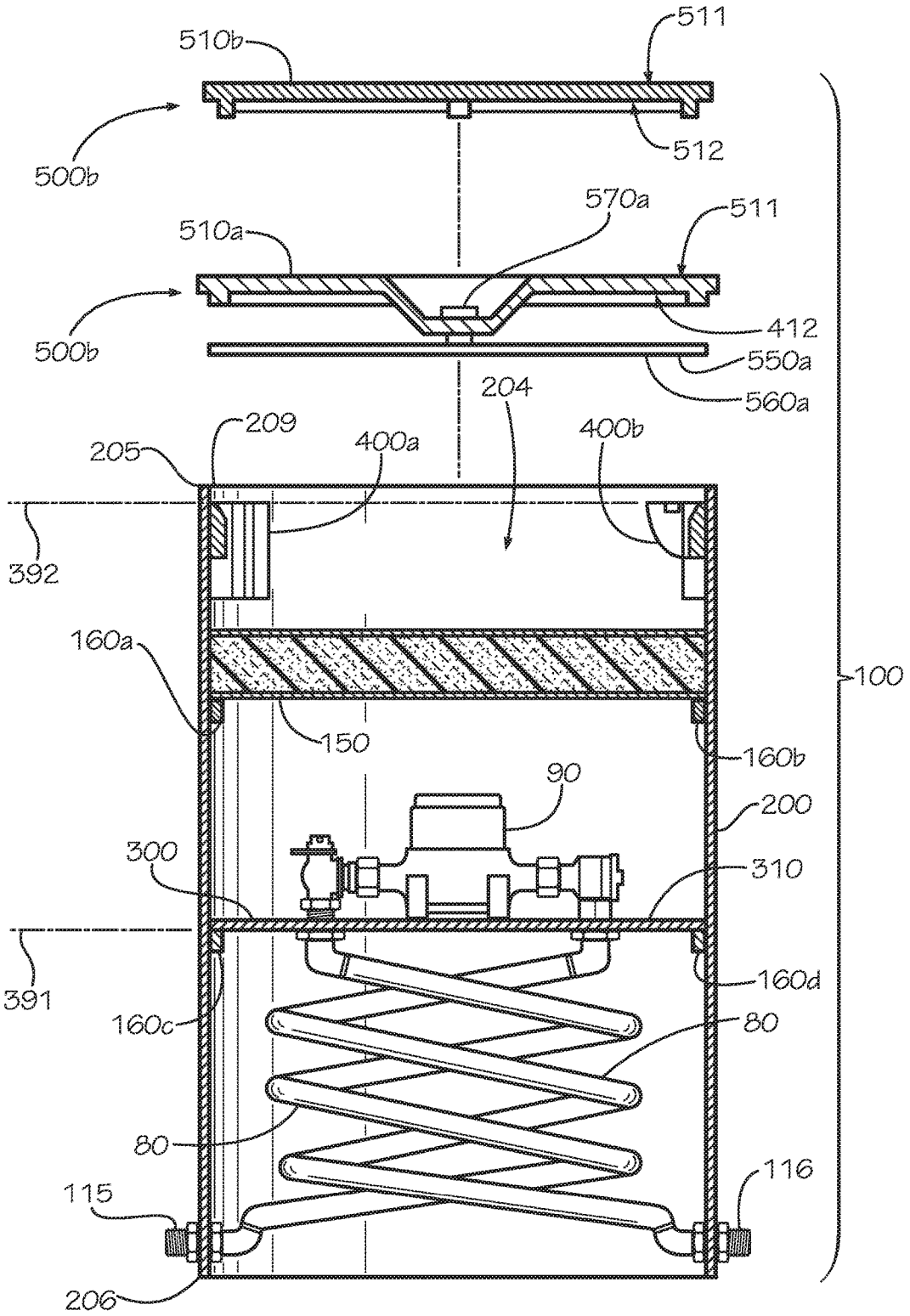
FIG. 2 is a partial sectional view of the pit assembly of FIG. 1 as partially assembled and taken along line 2-2 of FIG. 1 and showing two types of interchangeable lids.
Figure 3:
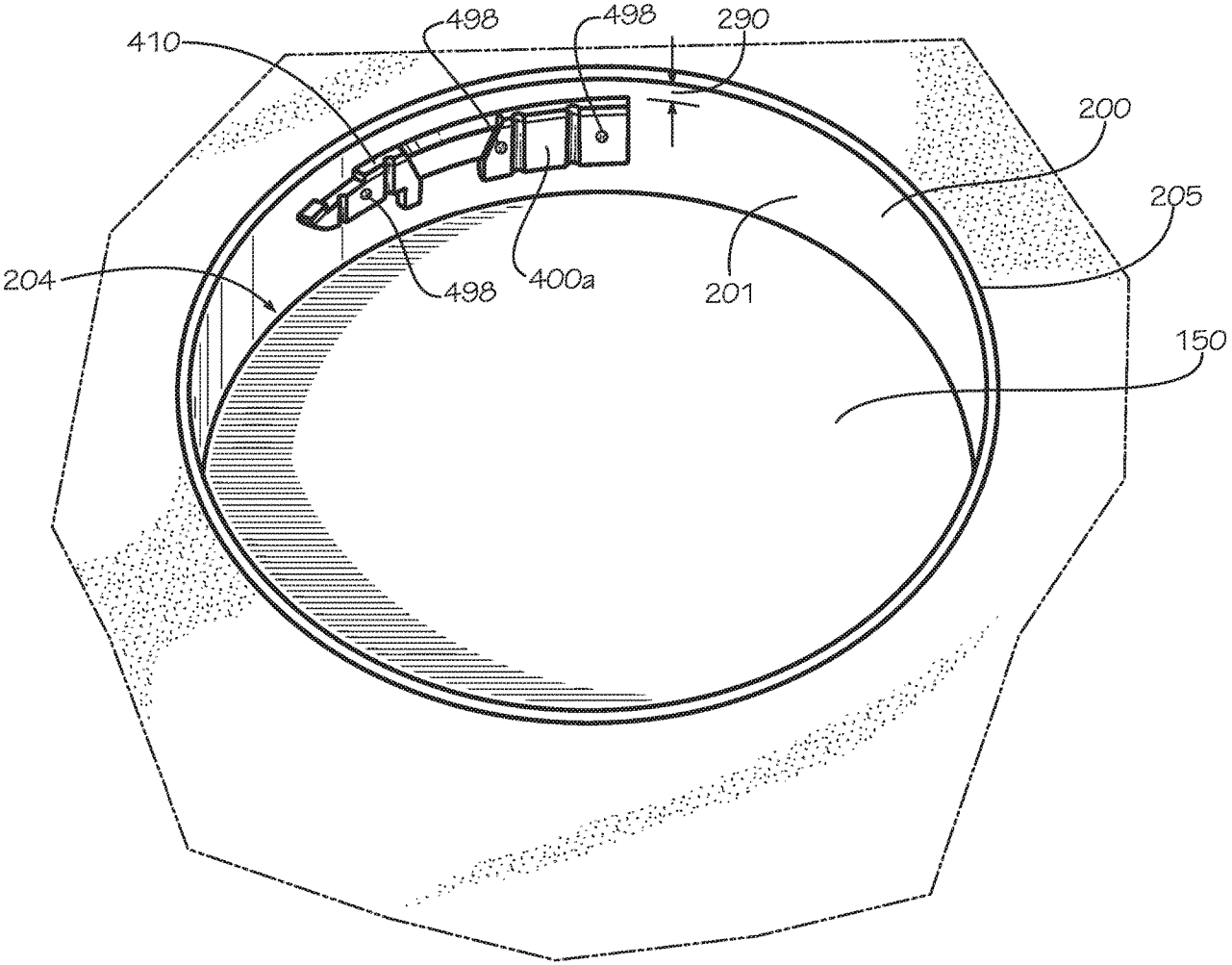
FIG. 3 is a top perspective view of the pit assembly of FIG. 1.

FIGS. 1-3 show a pit assembly 100. As shown in FIG. 1, in one aspect, the pit assembly 100 can comprise a pit wall 200, a first rail 400*a*, a second rail 400*b*, and a lid 500 (lids 500*a,b* shown in FIG. 2, lid 500*c* shown in FIG. 16). In other aspects, the pit assembly can comprise a single rail 400 or more than two rails 400. The pit wall 200 can define an inner surface 201, an outer surface 202, an upper end 205 defining a pit opening 209, and a lower end 206 (shown in FIG. 2). The inner surface 201 can define an interior cavity 204 (shown in FIG. 2). In one aspect, the pit wall 200 can be cylindrical in shape and thus the inner surface 201 and the outer surface 202 can be cylindrical. In another aspect, the pit wall 200 can have a different-shaped cross-section such as, for example and without limitation, a capsule shape, a square shape, a rectangular shape, or any polygonal or other closed shape. A nominal diameter of the cylindrical pit wall 200 can be between 15 and 24 inches. In one aspect, the second rail 400*b* can be secured to the inner surface 201 of the pit wall 200 at a position opposite the first rail 400*a*.

In one aspect, the pit assembly 100 can further comprise an inlet 115, an outlet 116, and a platform 300 positioned in the interior cavity 204 and comprising a meter 90 and tubing 80 (shown in FIG. 2) that can extend from the inlet 115 to the meter 90 and from the meter 90 to the outlet 116. The meter 90 and the tubing 80 can be coupled to the platform 300. In one aspect, the tubing 80 can be made flexible enough to allow vertical movement of the platform 300 towards the pit opening 209. In another aspect, the tubing 80 and the meter 90 are stationary within the interior cavity 204. In yet another aspect, the interior cavity 204 defined by the inner surface 201 of the pit wall 200 need not house a meter 90 or tubing 80 and instead can house other equipment, provide storage space inside the interior cavity 204, or provide passage for equipment, tools, or personnel from an area above the upper end 205 of the pit wall 200 to an area below the upper end 205 or even below the lower end 206 of the pit wall 200 (e.g., in the case of a manhole).

The platform 300 can comprise a platform panel 310 defining notches 320. In one aspect, each of the notches 320 can be sized to clear the rails 400*a,b* when the platform is raised and can be numbered in quantity and spaced apart by the same angle around the circumference of the pit wall 200 as the rails 400*a,b* are spaced apart. The platform can further comprise a tab or other feature for locking into a top notch 490 (shown in FIG. 4) of each rail 400*a,b*. In one aspect, the platform 300 can be rotated as it is raised inside the interior cavity 204. In another aspect, the platform 300 does not rotate but remains in the same angular position as it is raised.

As shown in FIG. 2, the pit assembly 100 can further comprise an insulation panel 150, which can be placed between the platform 300 and the pit opening 209 to reduce or eliminate heat transfer between a first portion of the interior cavity 204 that is above the insulation panel 150 and a second portion of the interior cavity 204 that is below the insulation panel 150. The insulation panel can reduce the risk of freezing of the tubing 80 and other components of the pit assembly 100. The pit assembly 100 can comprise supports 160*a,b* for supporting the insulation panel 150. The pit assembly 100 can further comprise supports 160*c,d* for supporting the platform 300 in a first, lower position 391. As will be described, the rails 400*a,b* can support the platform 300 in a second position 392 that is proximate to the pit opening 209 and higher than the first position 391.

Each of the lids 500*a,b,c* can comprise a lid panel 510*a,b,c* respectively, defining an upper surface 511 and a lower surface 512. The lid 500*a* comprises a locking mechanism 550*a* for engaging and securing the lid 500*a* to other components of the pit assembly 100 such as the rails 400*a,b*. More specifically, the lid 500*a* can comprise the lid panel 510*a* and the locking mechanism 550*a*, which can be a center-lock locking mechanism that comprises a latch 560*a*. The latch 560*a* can be an elongated bar with a rectangular cross-section and can be made to rotate about a center of the lid 500*a* by operation of a fastener 570*a*, which can comprise a pentagon nut or similar tamper-proof or non-tamper-proof fastener on one side. The lid 500*b* can comprise the lid panel 510*b* without any locking mechanism 550. The lids 500*a,b* shown in FIG. 2 are only two of various aspects of lids 500 having various diameters, various locking mechanisms 550, and various shapes and materials. In one aspect, each of the lids 500*a,b* can be circular in shape when viewed from a top of the lid 500*a,b*. In another aspect, the lid 500 can have a capsule shape, a square shape, a rectangular shape, or another polygonal or other shape.

As shown in FIG. 3, each of the rails 400*a,b* (400*b* shown in FIG. 2) can be secured to the inner surface 201 of the pit wall 200 using, for example and without limitation, a plurality of fasteners 498 such as rivets or screws, each of which can be made to extend through the rail 400*a,b* and the pit wall 200. In one aspect, the fasteners 498 can be permanent fasteners that are not designed to be removed such as, for example and without limitation, rivets. In another aspect, the fasteners 498 can be removable fasteners such as, for example and without limitation, screws. In one aspect, a top end 410 of the rail 400*a,b* can be offset from the upper end 205 of the pipe wall 200 by an offset distance 290. In another aspect, the offset distance 290 can be zero.

Figure 4:
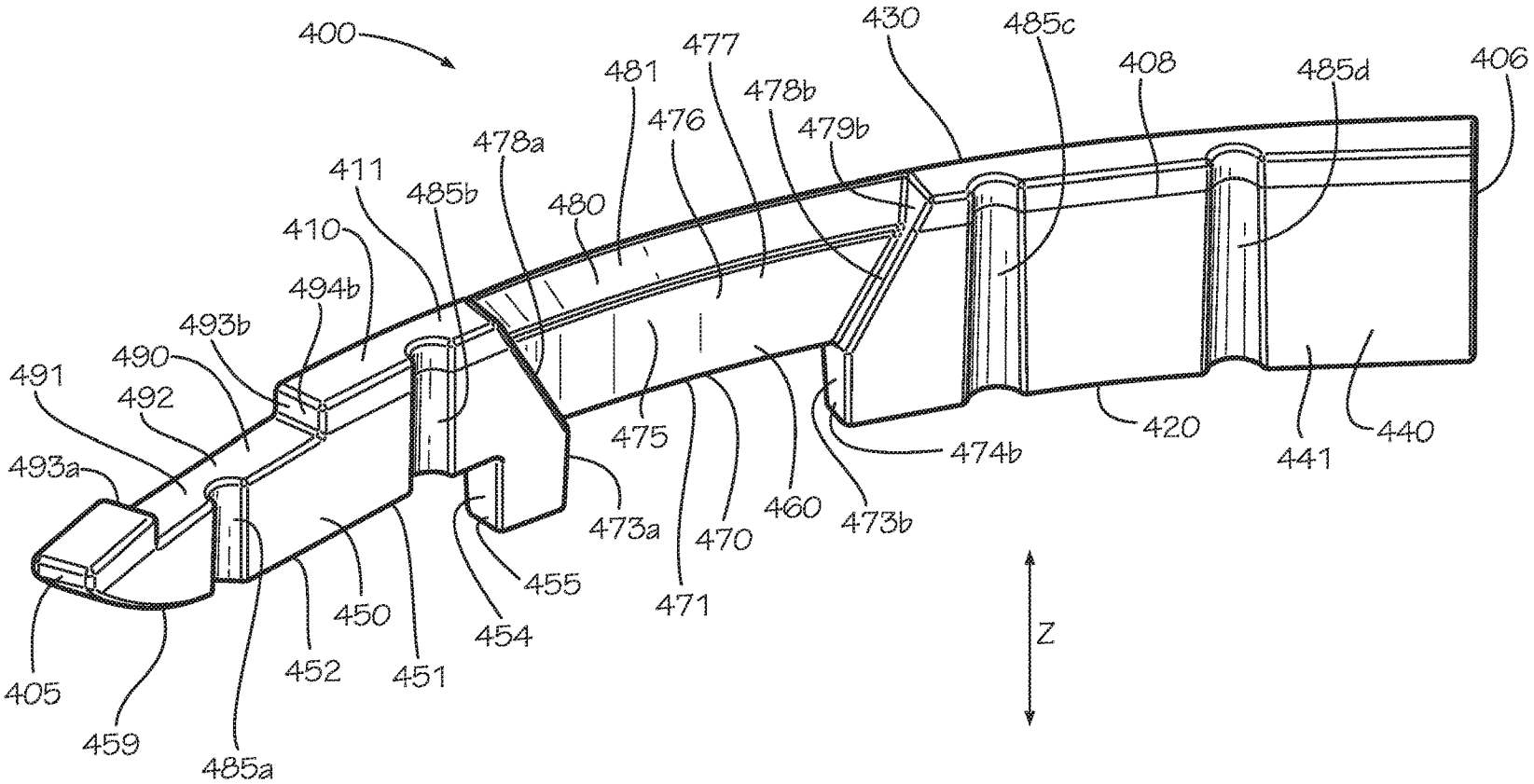
FIG. 4 is a top perspective view of a rail of the pit assembly of FIG. 1.
Figure 5:
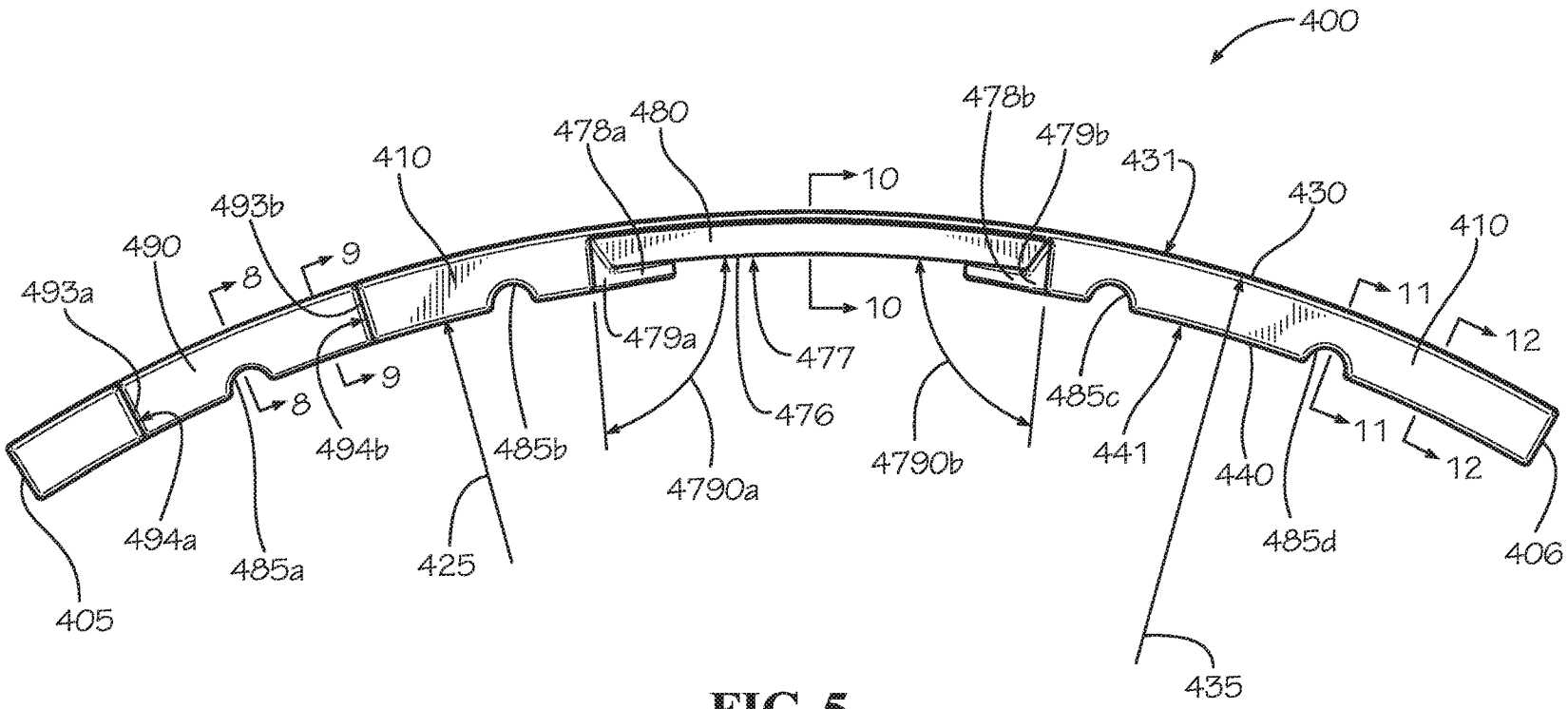
FIG. 5 is a top view of the rail of FIG. 4.
Figure 6:
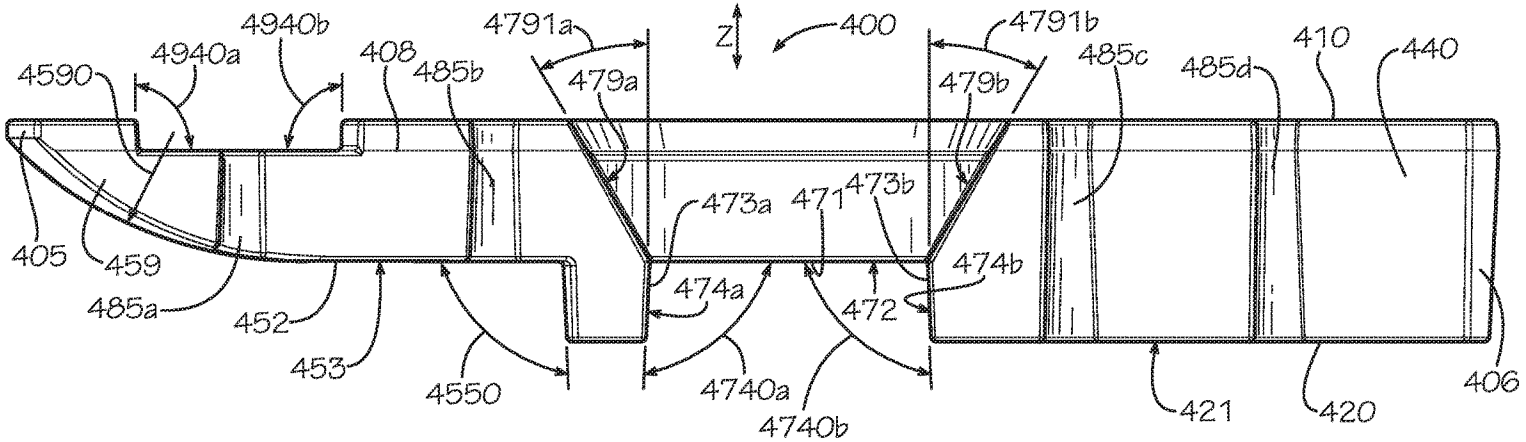
FIG. 6 is a front view of the rail of FIG. 4.

FIGS. 4-12 show various views of the rail 400. As shown in FIG. 4, the rail 400 can comprise the top end 410 defining a top surface 411 and a bottom end 420 distal from the top end 410 and defining a bottom surface 421 (shown in FIG. 6). The rail 400 can further comprise a first side end 405 and a second side end 406 distal from the first side end 405. The rail 400 can further comprise an outer face 430 (shown in FIG. 5) defining a radially outer surface 431 (shown in FIG. 5) extending from the top end 410 to the bottom end 420. The rail 400 can further comprise an inner face 440 defining a radially inner surface 441 extending from the top end 410 to the bottom end 420. In one aspect, the radially outer surface 431 can be curved in shape such that the rail 400 can be mounted on the inner surface 201 of the pit wall 200, including when the inner surface 201 on which the rail 400 is mounted is cylindrical or curved. The radially inner surface 441 can similarly be curved. In another aspect, either of the radially outer surface 431 or the radially inner surface 441 can be straight before securing the rail 400 to the pit wall 200, including when the inner surface 201 or a portion of the inner surface 201 on which the rail 400 is mounted is flat. In one aspect, the outer face 430 of the rail 400 can be mounted on the inner surface 201 of the pit wall 200.

The rail 400 can further comprise a center-lock strike portion 450 that is proximate to the first side end 405 and a side-lock strike portion 460 that is distal from the first side end 405. The side-lock strike portion 460 can be proximate to a center of the rail 400—and therefore distal from both the first side end 405 and the second side end 406. The center-lock strike portion 450, the side-lock strike portion 460, or both the center-lock strike portion 450 and the side-lock strike portion 460 can define a strike notch in the bottom end 420 of the rail 400. In one aspect, the center-lock strike portion 450 of the rail 400 can define a center-lock strike notch 451 that extends from the first side end 405 towards the second side end 406 and can comprise a central wall 452 (shown in FIG. 6) and a side wall 454. More specifically, a wall surface 455 of the side wall 454 can be angled with respect to a wall surface 453 (shown in FIG. 6) of the central wall 452 by an angle 4550 (shown in FIG. 6). In one aspect, the angle 4550 can measure about 90 degrees. In another aspect, the angle 4550 can measure greater than about 90 degrees in order to incorporate a draft angle. The angle 4550 can measure, for example and without limitation, about 92 degrees. In another aspect, the angle 4550 can be any angle between 0 and 180 degrees. In one aspect, the center-lock strike portion 450 of the rail 400 comprises a tapered portion 459 defining a taper starting at the first side end 405 to ease alignment and entry of the latch 560*a* of the locking mechanism 550*a* of the center-lock lid 500*a*. More specifically, the taper can be a radiused or curved taper as shown with a radius 4590 or a linear taper. In another aspect, the center-lock strike portion 450 of the rail 400 defines a radius starting at the first side end 405 for the same purpose. In yet another aspect, the center-lock strike portion 450 of the rail 400 contains no such tapered or radiused transition to the first side end 405. For example and without limitation, the central wall 452 can be flat and level from the first side end 405 to the side wall 454.

In one aspect, defining the center-lock strike portion 450 only on the first side end 405 of the rail 400 can ensure that an end user will only lock the center-lock lid 500*a* by rotating the fastener 570*a* in a clockwise direction and will only unlock the center-lock lid 500*a* by rotating the fastener 570*a* in a counterclockwise direction, thereby simplifying product instructions and matching the convention associated with the tightening and loosening of standard threaded fasteners (which are typically tightened by rotating in a clockwise direction and loosened by rotating in a counterclockwise direction). Inadvertent re-locking of the center-lock lid 500*a* by rotating the fastener 570*a* as far as possible in the counterclockwise direction will also be prevented. In another aspect, the center-lock strike portion 450 can be defined only on the second side end 406 or on both the first side end 405 and the second side end 406.

The side-lock strike portion 460 of the rail 400 can define a bottom strike notch 470 defining a central wall 471 (shown in FIG. 6) and a pair of side walls 473*a,b* (473*a* shown in FIG. 6) extending downward from the central wall 471. More specifically, a wall surface 472 (shown in FIG. 6) of the central wall 471 of the bottom strike notch 470 can be offset or recessed from a lowermost portion of the bottom surface 421 of the rail 400 such that the bottom strike notch 470 defines a measurable depth from the lowermost portion of the bottom surface 421. Furthermore, a wall surface 474*a,b* (474*a* shown in FIG. 6) of each of the pair of side walls 473*a,b* can be angled with respect to the wall surface 472 of the central wall 471. More specifically, each of the wall surfaces 474*a,b* of the respective side walls 473*a,b* can be angled with respect to the wall surface 472 of the central wall 471 by an angle 4740*a,b* (shown in FIG. 6). In one aspect, each of the angles 4740*a,b* can measure about 90 degrees. In another aspect, each of the angles 4740*a,b* can measure greater than about 90 degrees in order to incorporate a draft angle. Each of the angles 4740*a,b* can measure, for example and without limitation, about 92 degrees. In another aspect, each of the angles 4740*a,b* can measure any angle between 0 and 180 degrees.

In yet another aspect, the bottom strike notch 470 can comprise only one of the side walls 473*a,b*. For example and without limitation, the center-lock strike portion 450 and the side-lock strike portion 460 of the rail 400 can together define a bottom strike notch 451 defining a central wall 452 extending to the side wall 473*b* without interruption by any other side wall or side walls such as the side wall 454 and the side wall 473*a*. The wall surface 474*b* can be angled with respect to the wall surface 453 of the central wall 452. More specifically, the wall surface 474*b* of the side wall 473*b* can be angled with respect to the wall surface 453 of the central wall 452 by the angle 4740*a,b* (shown in FIG. 6). In yet another aspect, instead of the bottom strike notch 470, the rail 400 can comprise a cutout (not shown) in an interior portion of the inner face 440 (as opposed to a notch defined in the inner face 440 and the bottom end 420) that is sized to accept a latch 550*b* (shown in FIG. 16) of a side-lock lid 500*c* (shown in FIG. 16). Such a cutout can be oriented to provide clearance for the latch 550*b* when the latch 550*b* engages with the rail 400.

The side-lock strike portion 460 of the rail 400 can also define a face strike notch 475 defining a central wall 476 and side walls 478*a,b* (478*a* shown in FIG. 5) extending radially inward from the central wall 476. A radial direction is a direction pointing inward or outward from a center of a radius 435 of the rail 400 and an axial direction is a direction along a vertical axis Z shown that is aligned with an axis of the pit wall 200. The central wall 476 of the face strike notch 475 can be offset or recessed from a radially innermost portion of the radially inner surface 441 of the rail 400 such that the bottom strike notch 470 defines a measurable depth from the lowermost portion of the bottom surface 421. Furthermore, a wall surface 479*a,b* (479*a* shown in FIG. 5) of each of the pair of side walls 478*a,b* can be angled with respect to a front surface 477 of the central wall 476. More specifically, each of the wall surfaces 479*a,b* of the respective side walls 478*a,b* can be angled with respect to the front surface 477 of the central wall 476 by an angle 4790*a,b* (shown in FIG. 5). In one aspect, each of the angles 4790*a,b* can measure about 90 degrees. In another aspect, each of the angles 4790*a,b* can measure greater than about 90 degrees in order to incorporate a draft angle. Each of the angles 4790*a,b* can measure, for example and without limitation, about 92 degrees. In another aspect, each of the angles 4790*a,b* can measure any angle between 0 and 180 degrees. The side-lock strike portion 460 can define a rail thickness 710 (shown in FIG. 7) measured from the radially outer surface 431 of the outer face 430 to the front surface 477 of the face strike notch 475. In one aspect, the face strike notch 475 can be aligned vertically with the bottom strike notch 470. In one aspect, as shown, the side walls 478*a,b* and respective wall surfaces 479*a,b* can respectively transition into the side walls 473*a,b* and respective wall surfaces 474*a,b*. In another aspect, the side walls 478*a,b* and the side walls 473*a,b* need not connect nor intersect.

Further, each of the wall surfaces 479*a,b* can respectively be angled with respect to the top surface 411 of the top end 410 of the rail 400. More specifically, each of the wall surfaces 479*a,b* of the respective side walls 478*a,b* can be angled with respect to a vertical direction aligned with the vertical axis Z by an angle 4791*a,b* (shown in FIG. 6). In one aspect, each of the angles 4791*a,b* can measure about 30 degrees. In another aspect, each of the angles 4791*a,b* can measure greater than about 30 degrees in order to further ease entry of the latch 560*c* into the face strike notch 475. Each of the angles 4791*a,b* can measure, for example and without limitation, about 45 degrees. In another aspect, each of the angles 4791*a,b* can measure any angle between 0 and 90 degrees.

The rail thickness 710 and various other features of the rail 400 can together result in a rail 400 whose locking engagement with the locking mechanism 550*a,c* of the lids 500*a,c* is difficult to defeat. More specifically, the dimensions of the rail 400 can make tampering with the locking mechanism 550*a,c* difficult or impossible because the rail 400 blocks access to the locking mechanism 550*a,c*. The engagement of the locking mechanism 550*a,c* with the various notches can make removal of the lids 500*a,c* difficult or impossible.

In yet another aspect, the face strike notch 475 comprises only one of the side walls 478*a,b* or neither of the side walls 478*a,b*. For example and without limitation, the front surface 477 can be aligned flush with the radially inner surface 441 instead of offset from the radially inner surface 441 in a radially outward direction.

The side-lock strike portion 460 can further comprise a sloping portion 480 comprising a slope surface 481. The sloping portion 480 can be proximate to the top end 410 of the rail 400. The slope surface 481 of the sloping portion 480 can intersect with the front surface 477 of the central wall 476. Furthermore, the slope surface 481 can be angled with respect to the top surface 411 of the top end 410 of the rail 400 by a slope angle 4810. In one aspect, the slope angle 4810 can measure about 45 degrees. In another aspect, the slope angle 4810 can measure more than or less than about 45 degrees. The presence of the slope angle 4810 can facilitate the automatic engagement of the latch 560*c* of the lid 500*c* with the rail 400. The slope angle 4810 defined by the slope surface 481 can facilitate the engagement of the latch 560*c* of the lid 500*c* with the rail 400 by providing an inclined or "ramped" surface that can guide the latch 560*c* into the rail 400. Without the features described herein including the slope surface 481, it can become necessary for an end user to manually operate the locking mechanism 550*c* (e.g., by rotating the fastener 570*c*) while simultaneously lowering the lid 500*c*. Because of the weight of the lid 500*c* and the location of the pit assembly 100, a lid 500*c* that automatically engages the rail 400 can ease the positioning of the lid 500*c* on the pit assembly 100.

The top end 410 of the rail 400 can define the top notch 490 defining a central wall 491 and side walls 493*a,b* (493*a* shown in FIG. 5) extending upward from the central wall 491. The central wall 491 of the top notch 490 can be offset or recessed from a topmost portion of the top surface 411 of the rail 400 such that the bottom strike notch 470 defines a measurable depth from the lowermost portion of the bottom surface 421. Furthermore, a wall surface 494*a,b* (494*a* shown in FIG. 5) of each of the pair of side walls 493*a,b* can be angled with respect to a wall surface 492 of the central wall 491. More specifically, each of the wall surfaces 494*a,b* of the respective side walls 493*a,b* can be angled with respect to the wall surface 492 of the central wall 491 by an angle 4940*a,b* (shown in FIG. 6). In one aspect, each of the angles 4940*a,b* can measure about 90 degrees. In another aspect, each of the angles 4940*a,b* can measure greater than about 90 degrees in order to incorporate a draft angle. Each of the angles 4940*a,b* can measure, for example and without limitation, about 92 degrees. In another aspect, each of the angles 4940*a,b* can measure any angle between 0 and 180 degrees. In yet another aspect, the top notch 490 comprises only one of the side walls 493*a,b*.

The radially inner surface 441 of the inner face 440 can further define a plurality of flex channels 485*a,b,c,d*, each of the plurality of flex channels 485*a,b,c,d* extending from the top surface 411 of the rail 400 to the bottom surface 421 of the rail 400. Each of the flex channels 485*a,b,c,d* can increase the flexibility of the rail about the vertical axis Z such that each of a radius 425 or the radius 435 (shown in FIG. 5) of the radially inner surface 441 and the radially outer surface 431, respectively, can be increased or decreased as desired.

Figure 7:
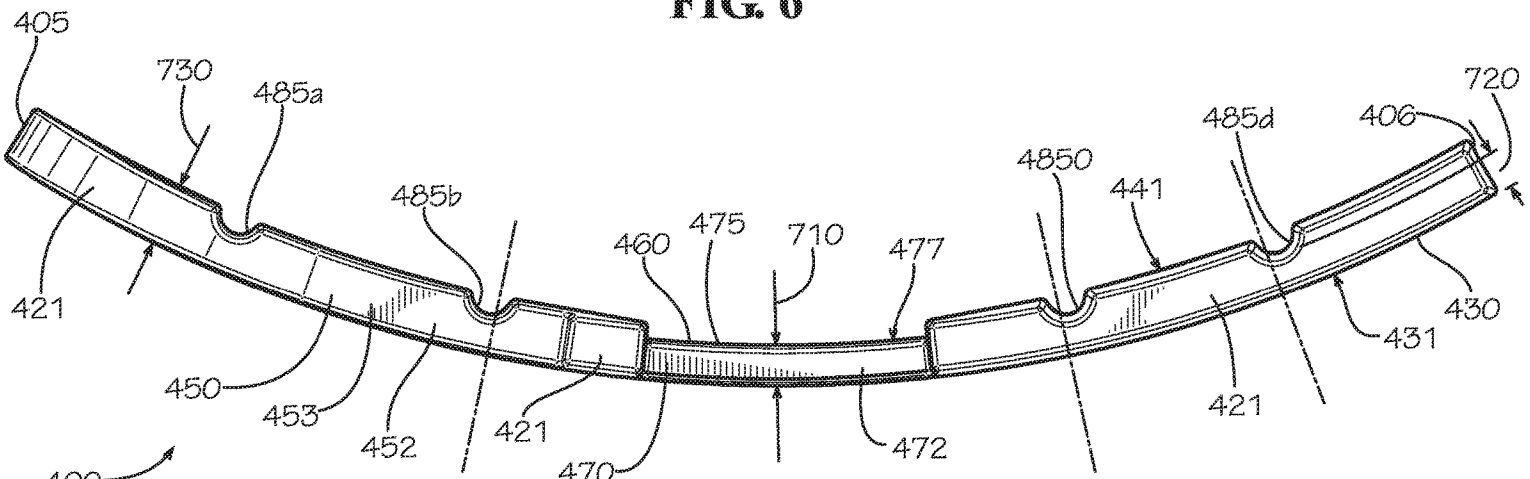
FIG. 7 is a bottom view of the rail of FIG. 4.
Figure 8:
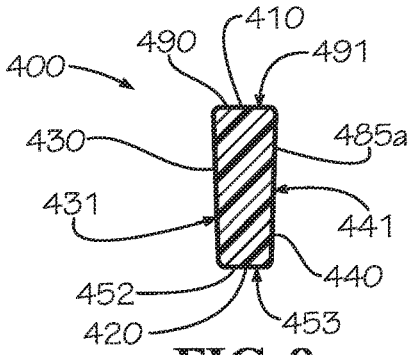
FIG. 8 is a sectional view of the rail of FIG. 4 taken along line 8-8 of FIG. 5.
Figure 9:
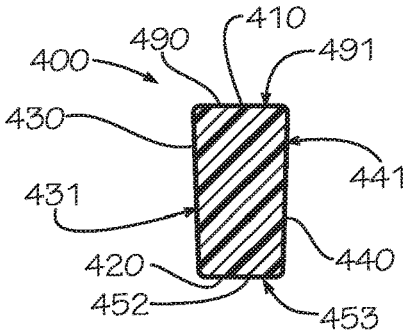
FIG. 9 is a sectional view of the rail of FIG. 4 taken along line 9-9 of FIG. 5.
Figure 10:
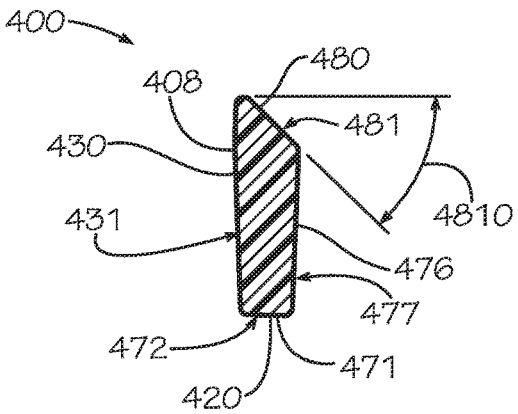
FIG. 10 is a sectional view of the rail of FIG. 4 taken along line 10-10 of FIG. 5.
Figure 11:
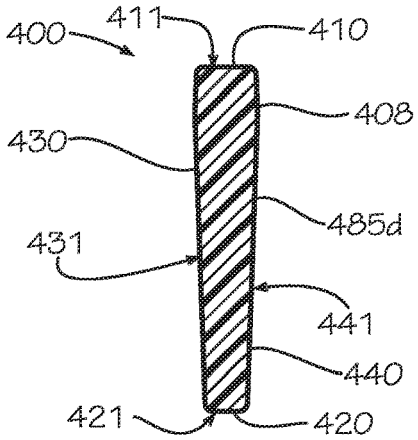
FIG. 11 is a sectional view of the rail of FIG. 4 taken along line 11-11 of FIG. 5.

As shown in FIG. 7, the rail 400 can define a rail thickness 720 that is measured from the radially outer surface 431 of the outer face 430 to the radially outermost portion of the flex channel 485*a,b,c,d*. In one aspect, the rail thickness 720 at each of the flex channels 485*a,b,c,d* can be equal to the rail thickness 710 at the side-lock strike portion 460, which can allow for more consistent bending of the rail 400 along its length from the first side end 405 to the second side end 406. The rail 400 can further define a rail thickness 730 that is measured from the radially outer surface 431 of the outer face 430 to the radially inner surface 441 of the inner face 440. In one aspect, as will be described, the rail thickness 730 can be thicker than the rail thickness 720 and the rail thickness 710 to provide a wider bottom surface 421 in the radial direction for engagement of the latches 560*a,b* of the locking mechanisms 550*a,b* or to provide additional protection against tampering with the locking mechanisms 550*a,b* or unauthorized access to the locking mechanisms 550*a,b*.

Figure 12:
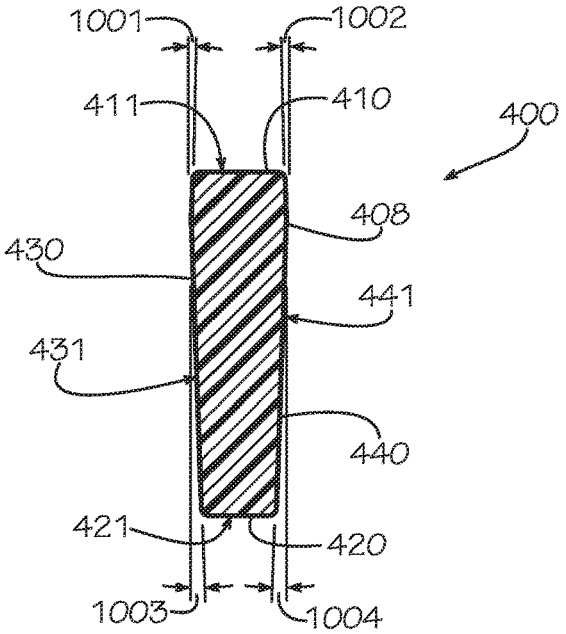
FIG. 12 is a sectional view of the rail of FIG. 4 taken along line 12-12 of FIG. 5.

As shown in FIGS. 8-12, either one or both of the radially inner surface 441 and the radially outer surface 431 can be angled with respect to a vertical axis through each cross-section of the rail 400 by angles 1001, 1002, 1003, 1004 shown in representative FIG. 12. In one aspect, each of the angles 1001, 1002, 1003, 1004 can be a draft angle measuring about two degrees. In another aspect, each of the angles 1001, 1002, 1003, 1004 can measure less than or more than two degrees. In yet another aspect, only the radially outer surface 431 of the outer face 430 of the rail 400 can be drafted in cases where, for example and without limitation, it is desirable for the top surface 411 of the top end 410 of the rail 400 to remain level even after mounting of the rail 400 to the vertical inner surface 201 of the pit wall 200.

Figure 13:
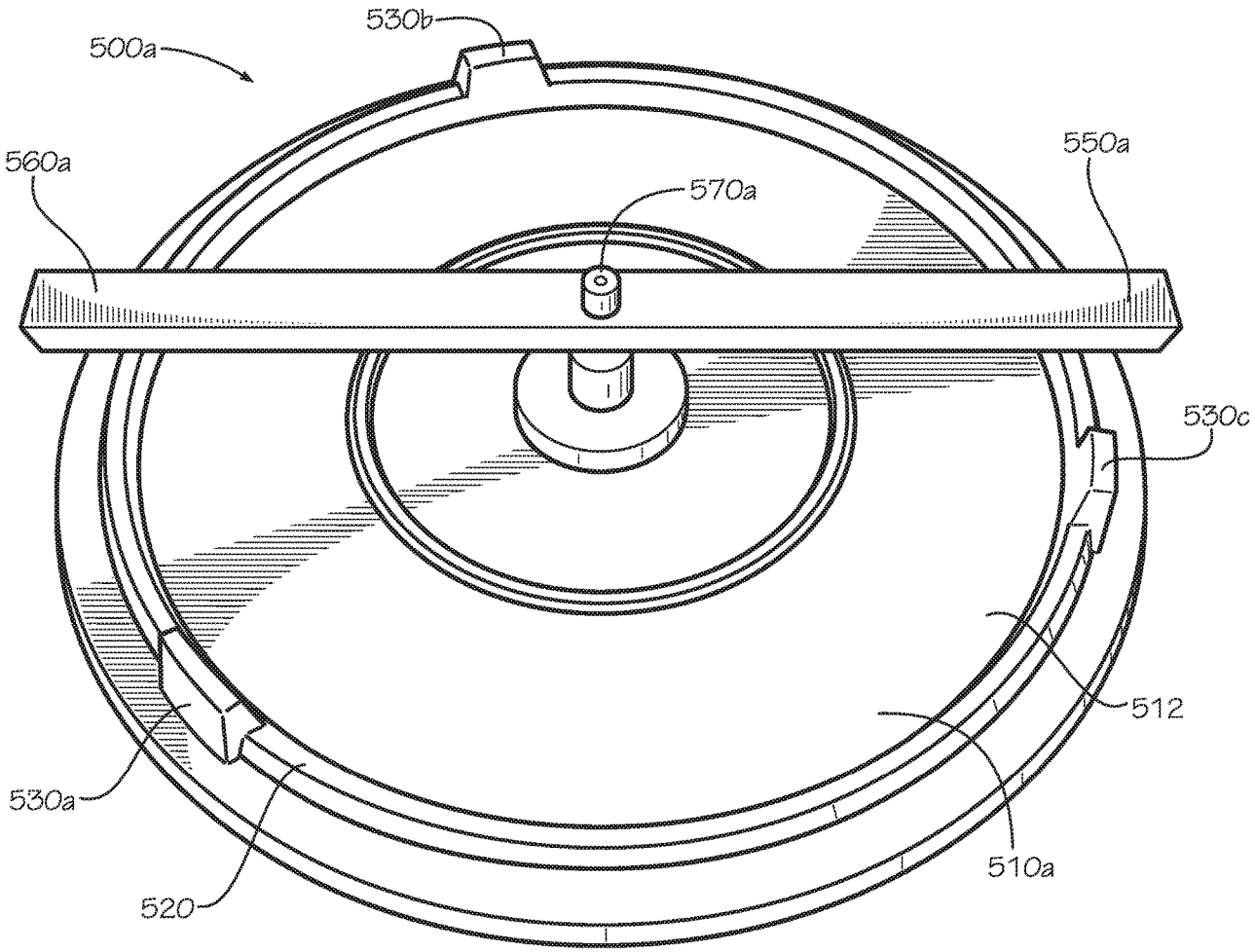
FIG. 13 is a bottom perspective view of a center-lock lid of the pit assembly of FIG. 2 in accordance with one aspect of the current disclosure.
Figure 14:
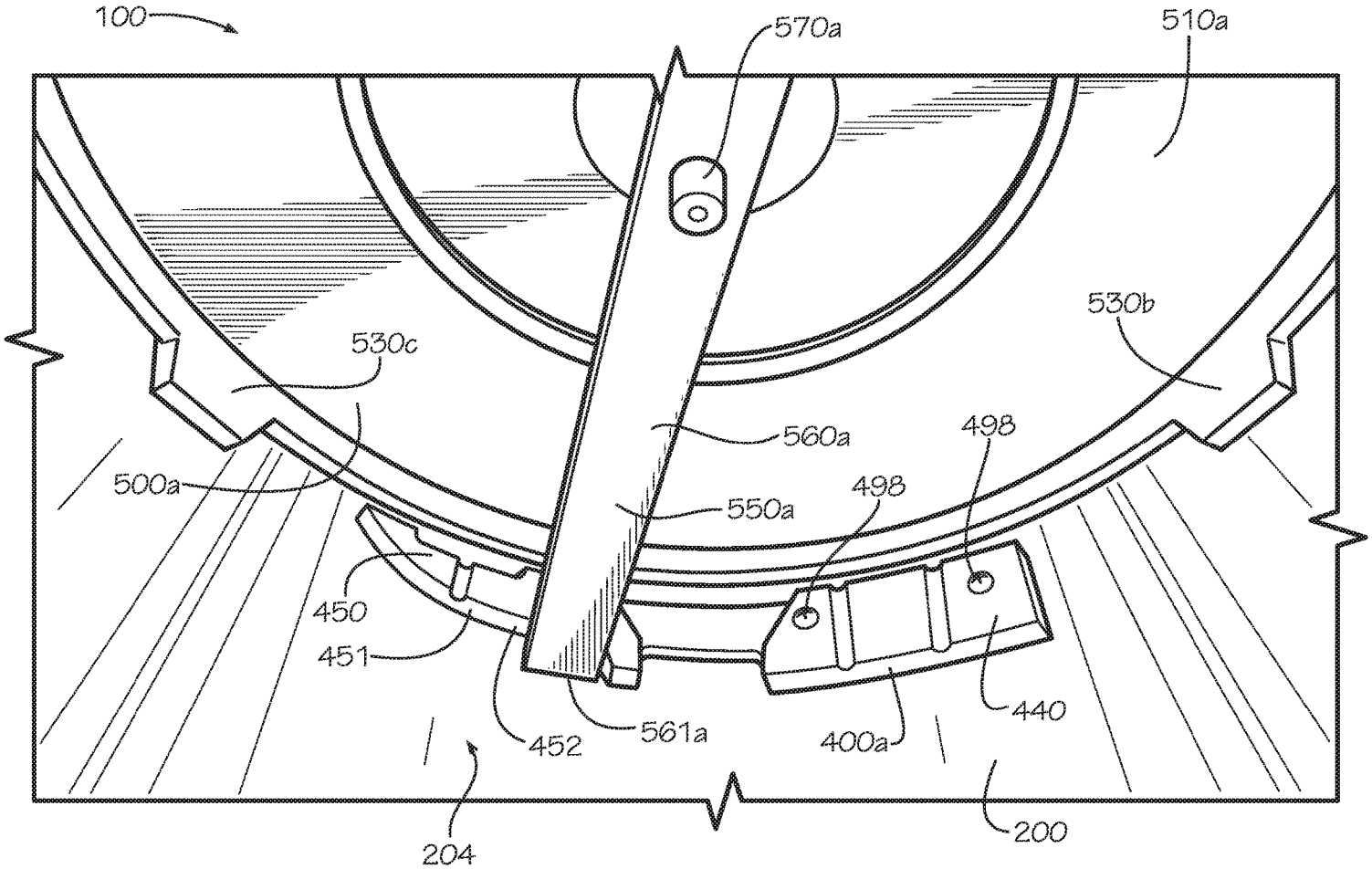
FIG. 14 is a bottom perspective view of the lid of FIG. 13 engaging with a first rail of the pit assembly of FIG. 4.
Figure 15:
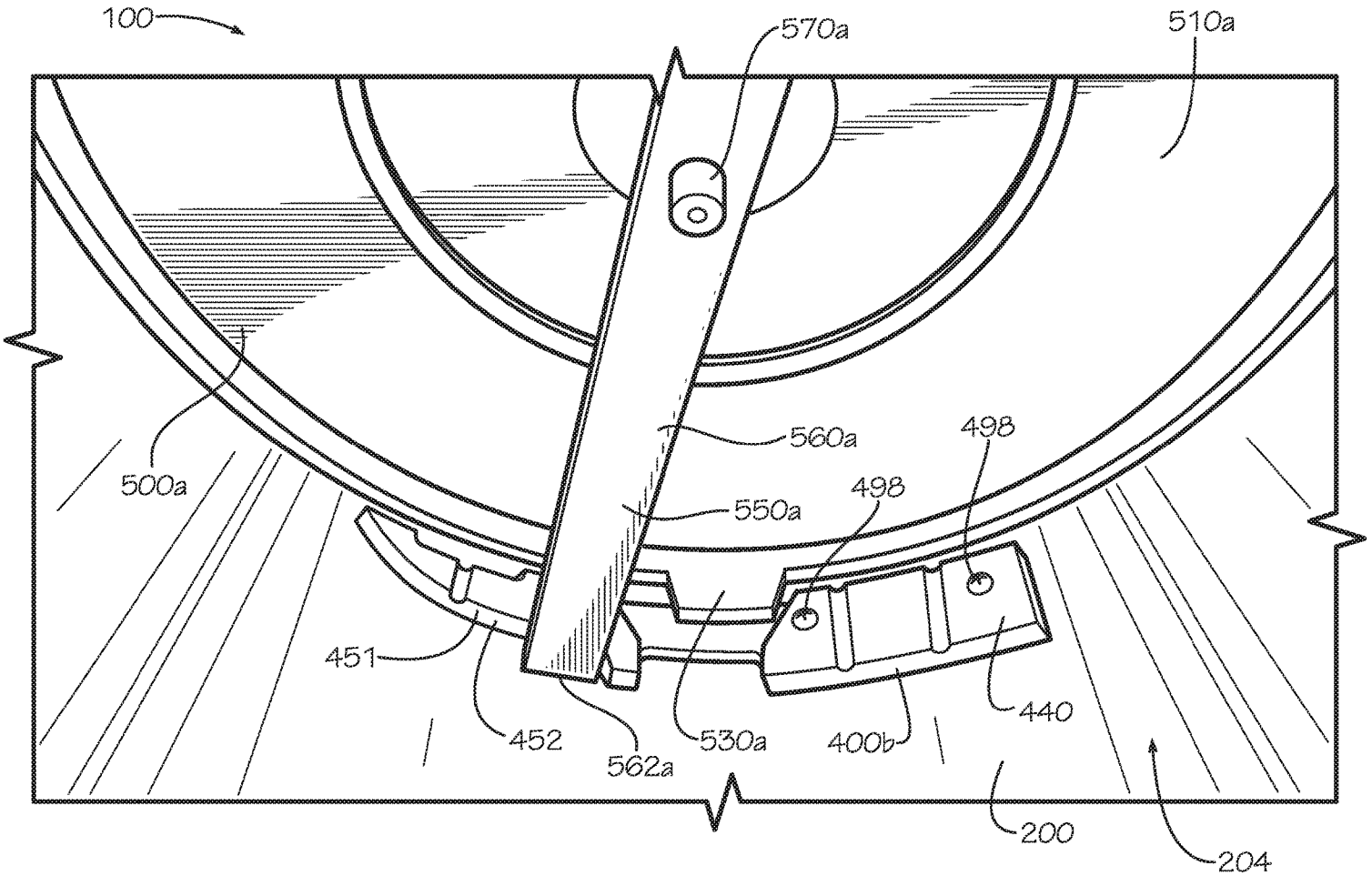
FIG. 15 is a bottom perspective view of the lid of FIG. 13 engaging with a second rail opposite the first rail of the pit assembly of FIG. 4.

FIGS. 13-15 show the construction and operation of the center-lock lid 500*a*. The center-lock lid 500*a* is so named because the locking mechanism 550*a* can be operated at a center of the center-lock lid 500*a* (e.g., by rotating the fastener 570*a*, shown from the side in FIG. 2 and from below in FIG. 13, from a position facing the upper surface 511 of the center-lock lid 500*a*). In one aspect, as shown in FIG. 13, the lid 500*a* can comprise the lid panel 510*a* defining the upper surface 511 (shown in FIG. 2) and the lower surface 512. The lid 500*a* can further comprise the locking mechanism 550*a* comprising a latch 560*a* coupled to the lower surface 512 with the fastener 570*a*. The lid panel 510*a* can further comprise a flange 520 extending from a flat interior portion of the lower surface 512 and tabs 530*a,b,c* extending from the lower surface 512 and from the flange 520. The flange 520 can help to align or position the lid 500*a* in the pit opening 509 and thereby also help position the locking mechanism 550*a* relative to the pit opening 509 and the rails 400*a,b* positioned proximate thereto.

As shown in FIG. 14, the lid 500*a* can be positioned over the pit opening 209 of the pit wall 200 such that a first end 561*a* of the latch 560*a* of the lid 500*a* engages the center-lock strike portion 450 of the first rail 400*a*. Interference between the first end 561*a* of the latch 560*a* and the central wall 452 of the bottom strike notch 451 prevents upward movement of the latch 560*a* relative to the first rail 400*a* to which the latch 560*a* is engaged, thereby preventing removal of the lid 500*a* from the pit opening 209. The weight of the lid 500*a* and friction between the lid 500*a* and the other components of the pit assembly 100 can prevent rotation of the lid 500*a* relative to the first rail 400*a* to which the first end 561*a* of the latch 560*a* is engaged.

As shown in FIG. 15, the lid 500*a* remains positioned over the pit opening 209 (not shown) of the pit wall 200 such that a second end 562*a* of the latch 560*a* of the lid 500*a* engages the center-lock strike portion 450 of the second rail 400*b*. Interference between the second end 562*a* of the latch 560*a* and the central wall 452 of the bottom strike notch 451 also prevents upward movement of the latch 560*a* relative to the second rail 400*b* to which the latch 560*a* is engaged, thereby additionally preventing removal of the lid 500*a* from the pit opening 209. Again, the weight of the lid 500*a* and friction between the lid 500*a* and the other components of the pit assembly 100 can prevent rotation of the lid 500*a* relative to the second rail 400*b* to which the second end 562*a* of the latch 560*a* is engaged.

In one aspect, the tabs 530*a,b,c* are offset radially inward from the radially innermost portion of the inner face 440 and thus play no role in the locking of the lid 500*a* even when aligned with the second rail 400*b* as shown in FIG. 15. In another aspect, any of the rails 400 can be sized and shaped to receive one or more of the tabs 530*a,b,c* in order to prevent rotation of the lid when the lid 500*a* is installed.

Figure 16:
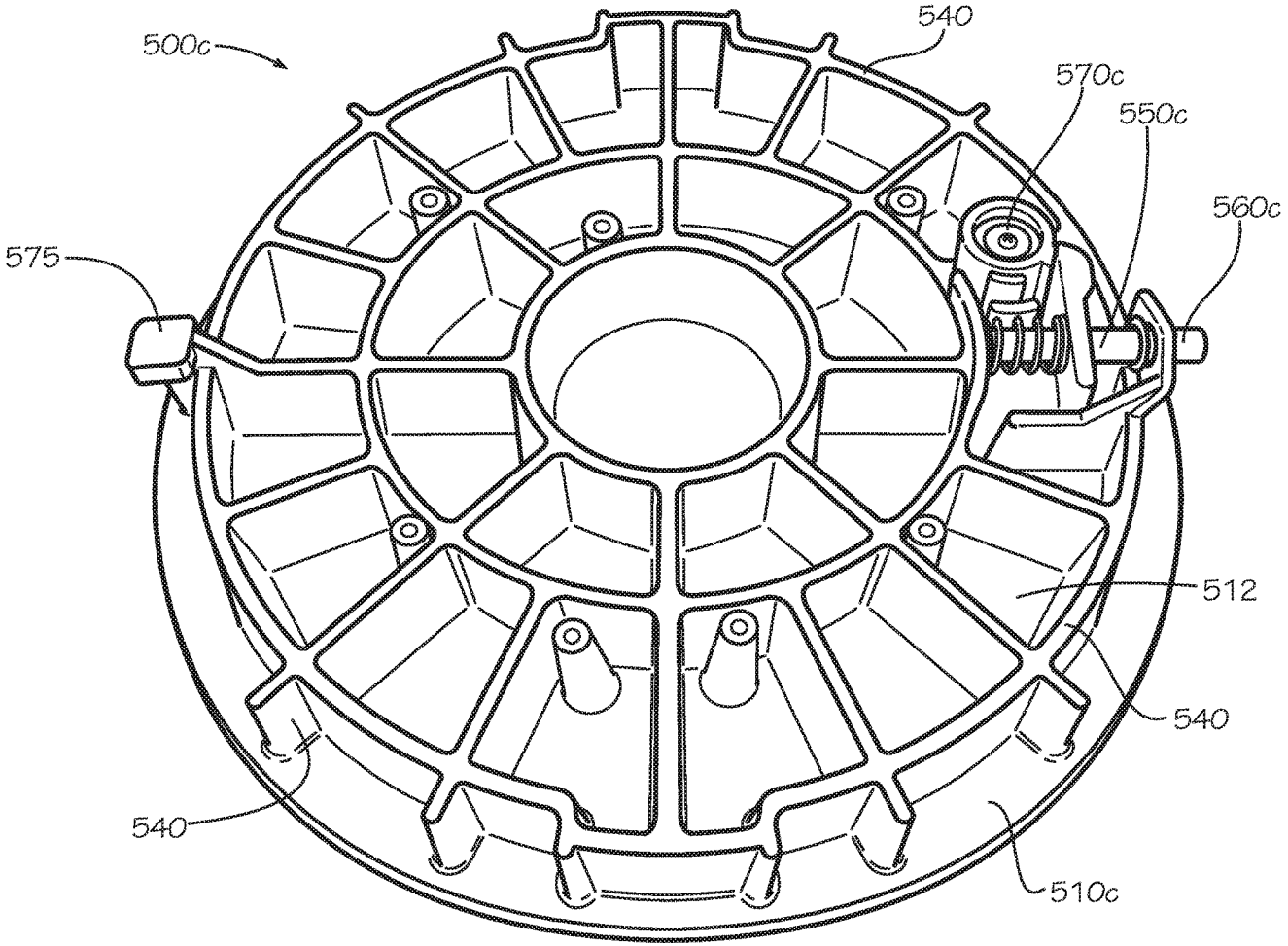
FIG. 16 is a bottom perspective view of a side-lock lid of the pit assembly of FIG. 2 in accordance with another aspect of the current disclosure.
Figure 17:
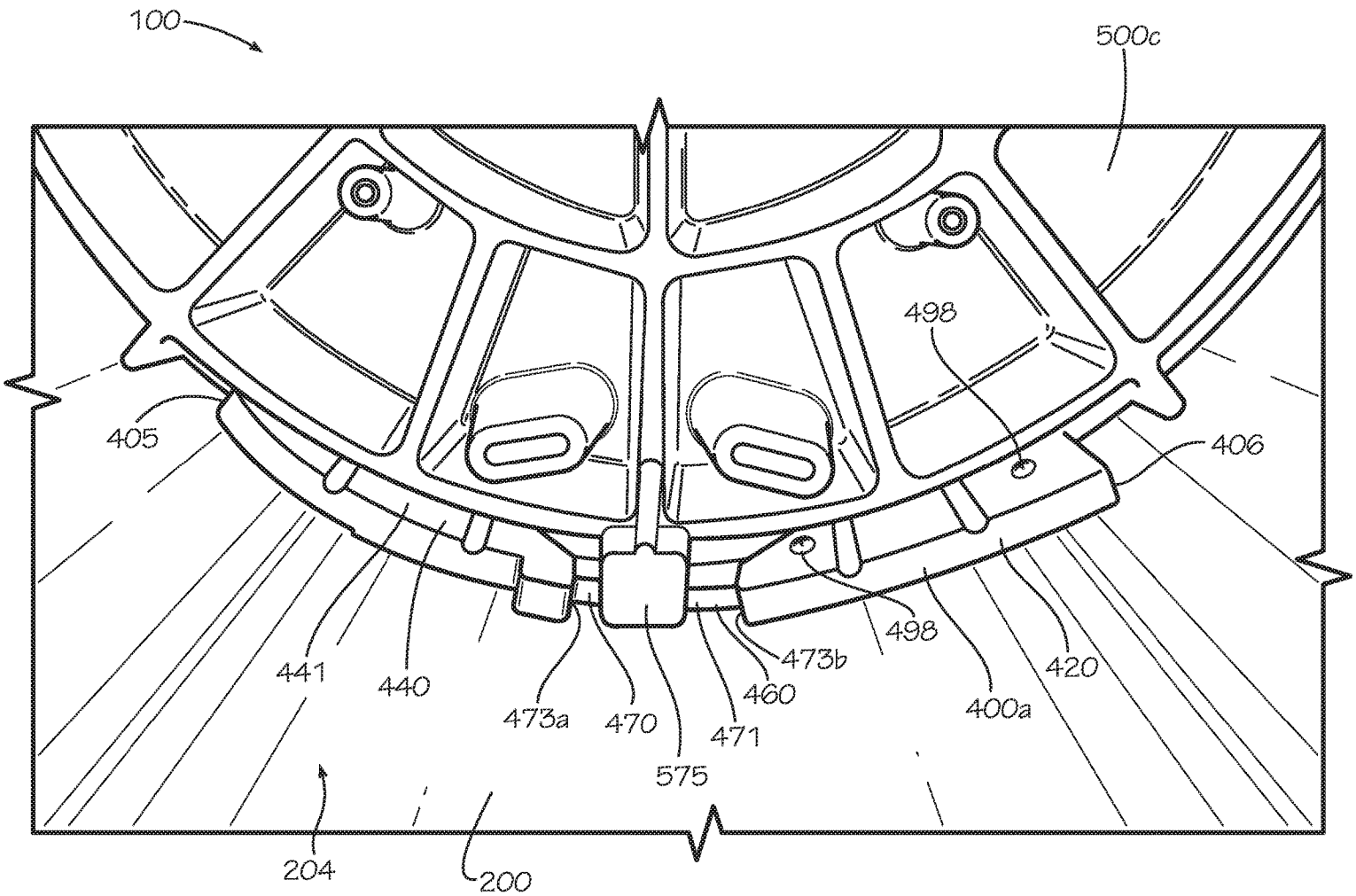
FIG. 17 is a bottom perspective view of the lid of FIG. 16 engaging with the first rail of the pit assembly of FIG. 4.
Figure 18:
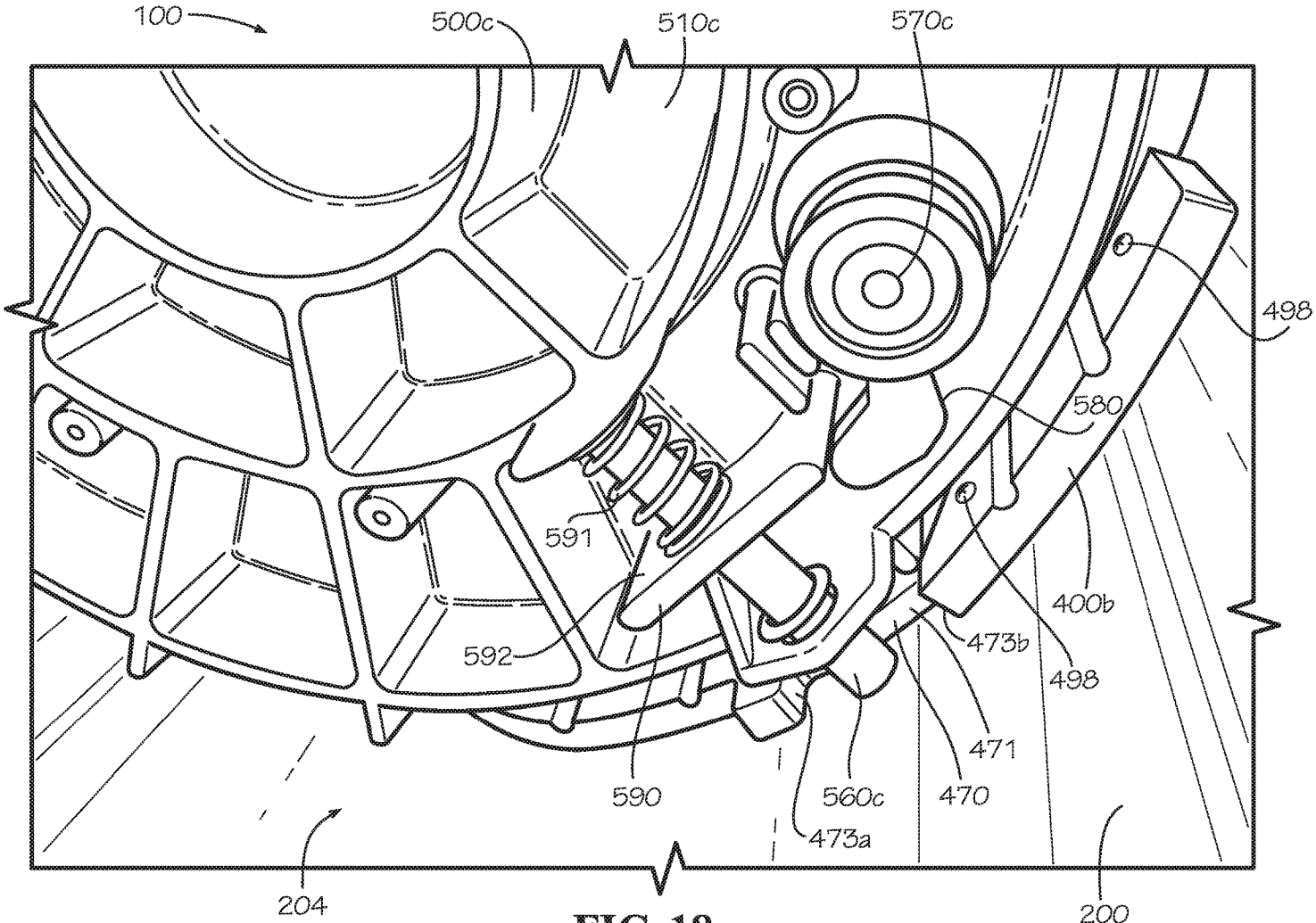
FIG. 18 is a bottom perspective view of the lid of FIG. 16 engaging with the second rail of the pit assembly of FIG. 4.

FIGS. 16-18 show the construction and operation of a side-lock lid 500*c*. The side-lock lid 500*c* is so named because the locking mechanism 550*c* can be operated at a side of the side-lock lid 500*c* (e.g., by rotating the fastener 570, shown from below in FIG. 16, from a position facing the upper surface 511 of the side-lock lid 500*c*). As shown in FIG. 16, the lid 500*c* can comprise a lid panel 510*c* defining the upper surface 511 and the lower surface 512 (not shown). The lid 500*c* can further comprise a locking mechanism 550*c*, which can comprise a latch 560*c* and a "tongue" or catch 575, which can be opposite the latch 560*c*. Both the latch 560*c* and the catch 575 can be coupled to the lower surface 512. The lid panel 510*c* can further comprise a plurality of ribs 540 extending from a flat interior portion of the lower surface 512. A portion of the ribs 540 can help to align or position the lid 500*c* in the pit opening 509 and thereby help position also the locking mechanism 550*c* relative to the pit opening 509 and the rails 400*a,b* positioned proximate thereto. The ribs 540 can alternatively or additionally be used to reinforce the lid panel 510*c*.

As shown in FIG. 17, the lid 500*c* can be positioned over the pit opening 209 (not shown) of the pit wall 200 such that the catch 575 of the lid 500*c* engages the side-lock strike portion 460 of the first rail 400*a*. Interference between the catch 575 and the central wall 471 of the bottom strike notch 470 prevents upward movement of the catch 575 relative to the first rail 400*a* to which the catch 575 is engaged, thereby preventing removal of the lid 500*c* from the pit opening 209. Interference between the catch 575 and the side walls 473*a,b* of the bottom strike notch 470 can prevent rotation of the lid 500*c* relative to the first rail 400*a* to which the catch 575 is engaged.

As shown in FIG. 18, the locking mechanism 550*c* can comprise the latch 560*c*, which can be a plunger, a cam 580 coupled to the lid panel 510*c* with the fastener 570*c*, and a biased plate mechanism 590 for moving the latch 560*c* in and out of an engagement position. The biased plate mechanism 590 can be biased with a spring 591 to the engagement position. By rotating the fastener 570*c* and thereby the cam 580, a plate 592 of the biased plate mechanism 590 can be made to move the plunger out of the engagement position. As shown, the latch 560*c* is in the engagement position. Interference between the latch 560*c* and the central wall 471 of the bottom strike notch 470 of the second rail 400*b* prevents upward movement of the latch 560*c* relative to the second rail 400*b* to which the latch 560*c* is engaged, thereby additionally preventing removal of the lid 500*c* from the pit opening 209. Interference between the latch 560*c* and the side walls 473*a,b* of the bottom strike notch 470 can prevent rotation of the lid 500*c* relative to the second rail 400*b* to which the latch 560*c* is engaged.

Thus, as shown in FIGS. 13-18, the rails 400*a,b* are capable of engaging and securing both center-lock lids 500*a* and side-lock lids 500*c*, as well as supporting lids 500*b* with no locking mechanisms. The rails 400*a,b* therefore provide the benefit of supplying pit assemblies 100 to end users with easily interchangeable lid configurations and thereby lower the associated manufacturing costs of manufacturing pit assemblies, eliminating the need to manufacture two or more types of rail configurations. An end user can therefore use multiple types of lids with a single pit assembly utilizing the rail 400. Further, because the flexible rail 400 can be used with the pit walls 200 having various diameters, the pit assemblies 100 that previously required six or more different rails—each having a different design—can be produced using simply the rail 400, which combines all of the supporting, locking, and other features of the previous rail variations.

The lid 500 can be formed from and thus comprise a metal such as iron, a plastic resin such as acrylonitrile butadiene styrene (ABS), a composite material, or any other material having the desired properties, e.g., strength and environmental resistance. The lid can comprise "touch reading" components or an access door.

The rail 400 can be formed from a molding process such as, for example and without limitation, injection molding, and thus can further comprise a parting line 408 (shown in FIG. 4). In one aspect, the parting line 408 can be positioned proximate to the intersection between the slope surface 481 of the sloping portion 480 and the front surface 477 of the central wall 476. In another aspect, the parting line can be positioned anywhere between the top end 410 and the bottom end 420 of the rail 400. In one aspect, the rail 400 can be a solid, integrally formed or one-piece structure. In another aspect, the rail 400 can be formed from multiple pieces. In yet another aspect, the rail 400 can comprise one or more hollow sections oriented, for example and without limitation, along a direction aligned with the vertical axis Z to reduce material usage and weight or to increase flexibility or for any other reason.

The rail 400 can be formed from and thus comprise a flexible material such as, for example and without limitation a polymer material such as acrylonitrile butadiene styrene (ABS) or high-density polypropylene (HDPE). In one aspect, the material used to form the rail 400 can comprise a reinforcing material such as fiberglass. In another aspect, the reinforcing material can comprise an aramid fiber or a carbon fiber. The resulting material can thus be a fiber-reinforced or "glass-filled" material that can be stronger than a non-reinforced material and yet retains its flexible qualities. The material used to form the rail 400 can be selected from a group of materials that are rigid enough to withstand wear during use (for example, due to abrasion by the lid 500) and that are flexible enough to bend, especially after being exposed to temperature extremes and/or impact by hard objects during actual use.

In one aspect, the rail 400 can be positioned on and secured to the pit wall using a special fixture/jig that locates and holds the position of the rail 400 during the assembly process. When, for example, a pair of rails 400*a,b* is mounted to opposite sides of the pit wall 200, such a fixture can simultaneously hold both the first rail 400*a* and the second rail 400*b* at the proper angular distance apart in at the proper offset distance 290 from the upper end 205 of the pit wall 200. In one aspect, the first rail 400*a* and the second rail 400 can be spaced 180 degrees apart. When, as is possible with the rail 400 disclosed herein, different pit diameters use the same rail 400, the rail 400 can be made flexible enough to take a smaller curve or a larger curve than the curve formed into the outer face 430 of the rail 400. Furthermore, the fixture can be made to create the smaller or larger curve as desired or such an operation can be formed by hand by measuring, placing, clamping and securing the rails 400 in the desired locations. In one aspect, a pair of rails 400*a,b* is sufficient to secure the lid 500, hold the platform 300, or otherwise perform the desired function. In another aspect, a single rail 400 is sufficient to secure the lid 500, hold the platform 300, or otherwise perform the desired function. In yet another aspect, more than two rails 400 can be used to perform the desired function or functions.

In one aspect, a method for accessing the pit assembly 100 comprising the rail 400 comprises removing a lid 500 of the pit assembly 100 from an upper end 205 of a pit wall 200 of the pit assembly 100; raising a platform 300 of the pit assembly 100; and supporting the platform with the rail 400 of the pit assembly 100. The method can further comprise positioning the lid 500 on the upper end 205 of the pit wall 200 and engaging a locking mechanism 550 of the lid 500 with a one of the center-lock strike portion 450 and the side-lock strike portion 460 of the rail 400.

Supporting the platform 300 can comprise locking a tab or boss on a bottom or a side of the platform 300 in the top notch 490 defined in the top end 410 of the rail 400. In one aspect using the center-lock lid 500*a*, engaging the locking mechanism 550 of the lid 500 can comprise rotating the locking mechanism 550 of the center-lock lid 500*a* to engage the center-lock strike portion 450 of the rail, the locking mechanism 550*a* contacting the side wall 454 of the bottom strike notch 451. In another aspect using the side-lock lid 500*c*, engaging the locking mechanism 550*c* of the lid 500*c* can comprise retracting the locking mechanism 550*c* of the side-lock lid 500*c* by pushing the latch 560*c* of the locking mechanism 550*c* with the slope surface 481 of the side-lock strike portion 460 of the rail 400. Engaging the locking mechanism 550*c* of the lid 500*c* can further comprise guiding the latch 560*c* of the locking mechanism of the side-lock lid 500*c* between the pair of side walls 478*a,b* of the face strike notch 475 of the side-lock strike portion 460 of the rail 400. Engaging the locking mechanism 550 of the lid can further comprise inserting the latch 560*a,c* of the locking mechanism 550*a,c* into the strike notch 451, 470, 475.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A pit assembly comprising:

a pit wall defining an inner surface, an outer surface, an upper end defining a pit opening, and a lower end, the inner surface defining an interior cavity;

a first rail secured to the inner surface of the pit wall, the first rail comprising:

a top end defining a top surface, a bottom end distal from the top end and defining a bottom surface, a first side end, a second side end distal from the first side end, an outer face defining a curved radially outer surface extending from the top end to the bottom end and mounted on the inner surface of the pit wall, and an inner face distal from the outer face and defining a radially inner surface;

a center-lock strike portion proximate to the first side end; and a side-lock strike portion distal from the first side end, a one of the center-lock strike portion and the side-lock strike portion defining a strike notch in the bottom end, a central wall of the strike notch offset from a one of a radially innermost portion of the radially inner surface and the bottom surface of the first rail;

a lid defining an upper surface and a lower surface and comprising a locking mechanism, the locking mechanism coupled to the lower surface and configured to engage a one of the center-lock strike portion and the side-lock strike portion of each of the plurality of rails; and a second rail secured to the inner surface of the pit wall at a position opposite the first rail.

2. The assembly of claim 1, wherein the first rail comprises a flexible material.

3. The assembly of claim 1, wherein the first rail comprises a fiber-reinforced material.

4. The assembly of claim 1, wherein a nominal diameter of the pit wall is between 15 and 24 inches.

5. The assembly of claim 1, wherein the central wall of the strike notch is offset from the bottom surface of the first rail.

6. The assembly of claim 1, wherein the strike notch is a bottom strike notch.

7. The assembly of claim 6, the first rail further comprising a face strike notch, the face strike notch comprising a face strike notch central wall and a pair of face strike notch side walls, the face strike notch offset from the inner surface of the first rail and a surface of each of the pair of face strike notch side walls angled with respect to the face strike notch central wall.

8. The assembly of claim 6, wherein the bottom strike notch comprises a bottom strike notch side wall.

9. The assembly of claim 6, wherein the bottom strike notch comprises a pair of bottom strike notch side walls.

10. The assembly of claim 6, wherein the bottom strike notch comprises only one bottom strike notch wall.

11. The assembly of claim 1, wherein:

locking mechanism is a center-lock lid; and the center-lock strike portion comprises a tapered portion configured to ease alignment of the locking mechanism.

12. The assembly of claim 1, further comprising:

an inlet into the interior cavity;

an outlet out of the interior cavity; and a platform positioned in the interior cavity, the platform comprising a meter, and tubing extending from the inlet to the meter and from the meter to the outlet.

13. The assembly of claim 12, wherein the tubing is configured to be flexible enough to allow vertical movement of the platform towards the pit opening.

14. The assembly of claim 13, wherein the platform defines a platform notch, the notch configured to clear the first rail when the platform is raised.

15. The assembly of claim 14, wherein:

the first rail further comprises a top notch; and the platform further comprises a tab configured to lock into the top notch.

16. A pit assembly comprising:

a pit wall defining an inner surface, an outer surface, an upper end defining a pit opening, and a lower end, the inner surface defining an interior cavity;

a rail secured to the inner surface of the pit wall, the rail comprising:

a top end defining a top surface, a bottom end distal from the top end and defining a bottom surface, a first side end, a second side end distal from the first side end, an outer face defining a curved radially outer surface extending from the top end to the bottom end and mounted on the inner surface of the pit wall, and an inner face distal from the outer face and defining a radially inner surface;

a center-lock strike portion proximate to the first side end; and a side-lock strike portion distal from the first side end, a one of the center-lock strike portion and the side-lock strike portion defining a strike notch in the bottom end, a central wall of the strike notch offset from the bottom surface of the rail; and a lid defining an upper surface and a lower surface and comprising a locking mechanism, the locking mechanism coupled to the lower surface and configured to engage a one of the center-lock strike portion and the side-lock strike portion of the rail.

17. A pit assembly comprising:

a pit wall defining an inner surface, an outer surface, an upper end defining a pit opening, and a lower end, the inner surface defining an interior cavity;

a rail secured to the inner surface of the pit wall, the rail comprising:

a top end defining a top surface, a bottom end distal from the top end and defining a bottom surface, a first side end, a second side end distal from the first side end, an outer face defining a curved radially outer surface extending from the top end to the bottom end and mounted on the inner surface of the pit wall, and an inner face distal from the outer face and defining a radially inner surface;

a center-lock strike portion proximate to the first side end; and a side-lock strike portion distal from the first side end, a one of the center-lock strike portion and the side-lock strike portion defining a strike notch in the bottom end, a central wall of the strike notch offset from a one of a radially innermost portion of the radially inner surface and the bottom surface of the rail; and a lid defining an upper surface and a lower surface and comprising a locking mechanism that is a center-lock lid, the locking mechanism coupled to the lower surface and configured to engage a one of the center-lock strike portion and the side-lock strike portion of the rail, the center-lock strike portion comprising a tapered portion configured to ease alignment of the locking mechanism.

18. A pit assembly comprising:

a pit wall defining an inner surface, an outer surface, an upper end defining a pit opening, and a lower end, the inner surface defining an interior cavity;

a rail secured to the inner surface of the pit wall, the rail comprising:

a top end defining a top surface, a bottom end distal from the top end and defining a bottom surface, a first side end, a second side end distal from the first side end, an outer face defining a curved radially outer surface extending from the top end to the bottom end and mounted on the inner surface of the pit wall, and an inner face distal from the outer face and defining a radially inner surface;

a center-lock strike portion proximate to the first side end; and a side-lock strike portion distal from the first side end, a one of the center-lock strike portion and the side-lock strike portion defining a strike notch in the bottom end, a central wall of the strike notch offset from a one of a radially innermost portion of the radially inner surface and the bottom surface of the rail;

a lid defining an upper surface and a lower surface and comprising a locking mechanism, the locking mechanism coupled to the lower surface and configured to engage a one of the center-lock strike portion and the side-lock strike portion of the rail;

an inlet into the interior cavity;

an outlet out of the interior cavity; and a platform positioned in the interior cavity, the platform comprising a meter, and tubing extending from the inlet to the meter and from the meter to the outlet.

19. The assembly of claim 18, wherein the tubing is configured to be flexible enough to allow vertical movement of the platform towards the pit opening.

20. The assembly of claim 19, wherein the platform defines a platform notch, the notch configured to clear the rail when the platform is raised.

21. The assembly of claim 20, wherein:

the rail further comprises a top notch; and the platform further comprises a tab configured to lock into the top notch.

* * * * *